US005299590A

United States Patent [19]

Deibert et al.

[11] Patent Number: 5,299,590

[45] Date of Patent: Apr. 5, 1994

[54] SUN SHADE STRUCTURE

[76] Inventors: Linden K. Deibert, 22316 Caminito Arroyo Seco, Laguna Hills, Calif. 92653; Reginald P. Whittingham, 2291 Silktree, Tustin, Calif. 92680

[21] Appl. No.: 771,060

[22] Filed: Oct. 2, 1991

[51] Int. Cl.[5] ..... E04H 15/40

[52] U.S. Cl. ..... 135/104; 135/102

[58] Field of Search ..... 135/104, 102

[56] References Cited

U.S. PATENT DOCUMENTS 2,142,851 1/1939 Jolly ..... 135/102
2,266,853 12/1941 Dabney ..... 135/104
2,829,659 4/1958 Megenity ..... 135/102
3,190,300 6/1965 Wear'n ..... 135/104
3,394,720 7/1968 Moss ..... 135/104
3,465,765 9/1969 Dietz ..... 135/104

*Primary Examiner*—Henry E. Raduazo

[57] ABSTRACT

This invention relates to a multi purpose and multi positional outdoor shelter or shade. The shelter is self supporting and free standing with a maximum of three (3) flexible rods held in compression by a fabric covering held in mutual tension by said flexible rod members. The structure is also lightweight, easily erected and collapsed for portage.

4 Claims, 2 Drawing Sheets

SUN SHADE STRUCTURE

FIELD OF THE INVENTION

This invention relates generally to shelters such as tents, and is more specifically directed toward a simplified collapsible shelter.

BRIEF DESCRIPTION OF THE DRAWINGS

The accompanying drawings illustrate the invention. In such drawings.

DETAILED DESCRIPTION OF THE PREFERRED EMBODIMENT

Figure 1:
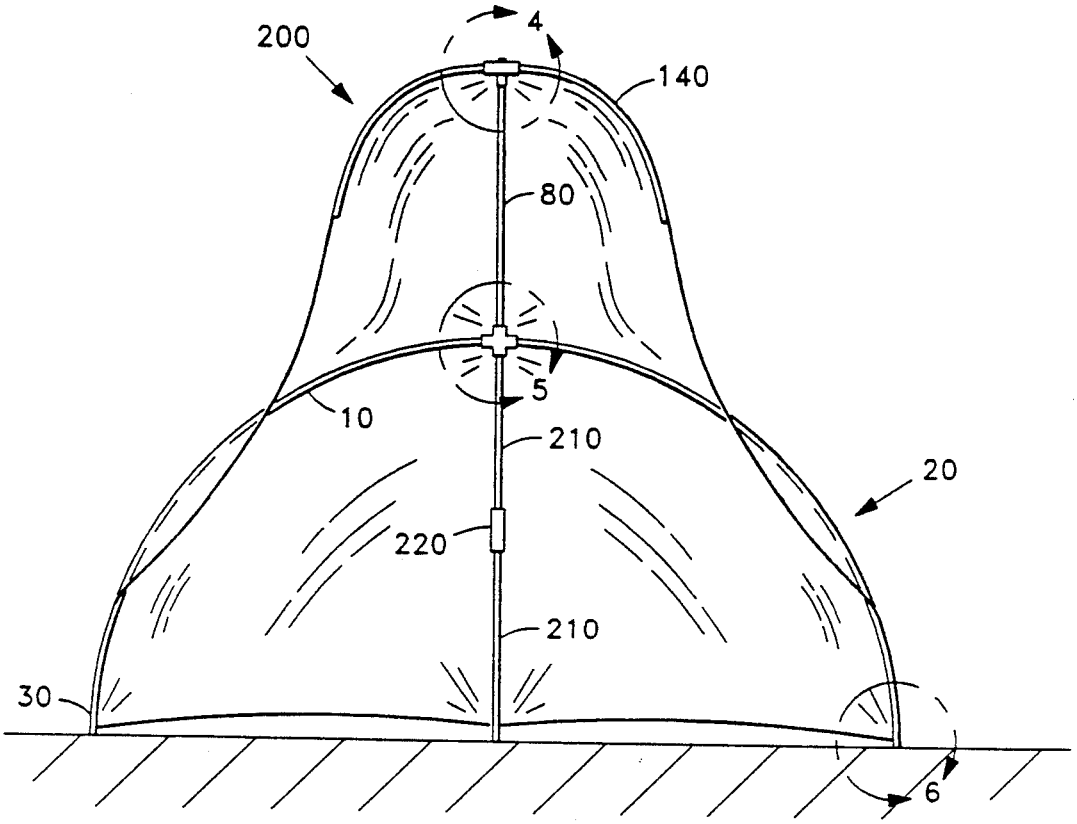
FIG. 1 is a front elevational view of the invention.
Figure 2:
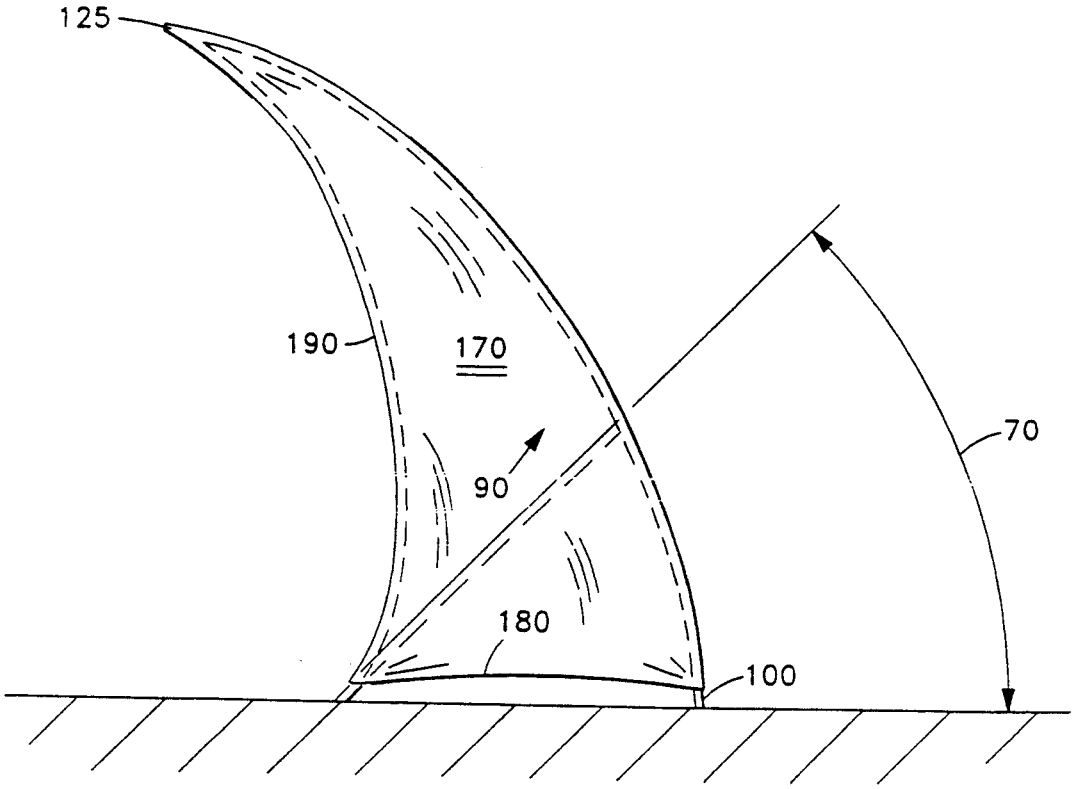
FIG. 2 is a left side elevational view of the invention, illustrating an acute angle between a plane of an arch and a horizontal surface.
Figure 3:
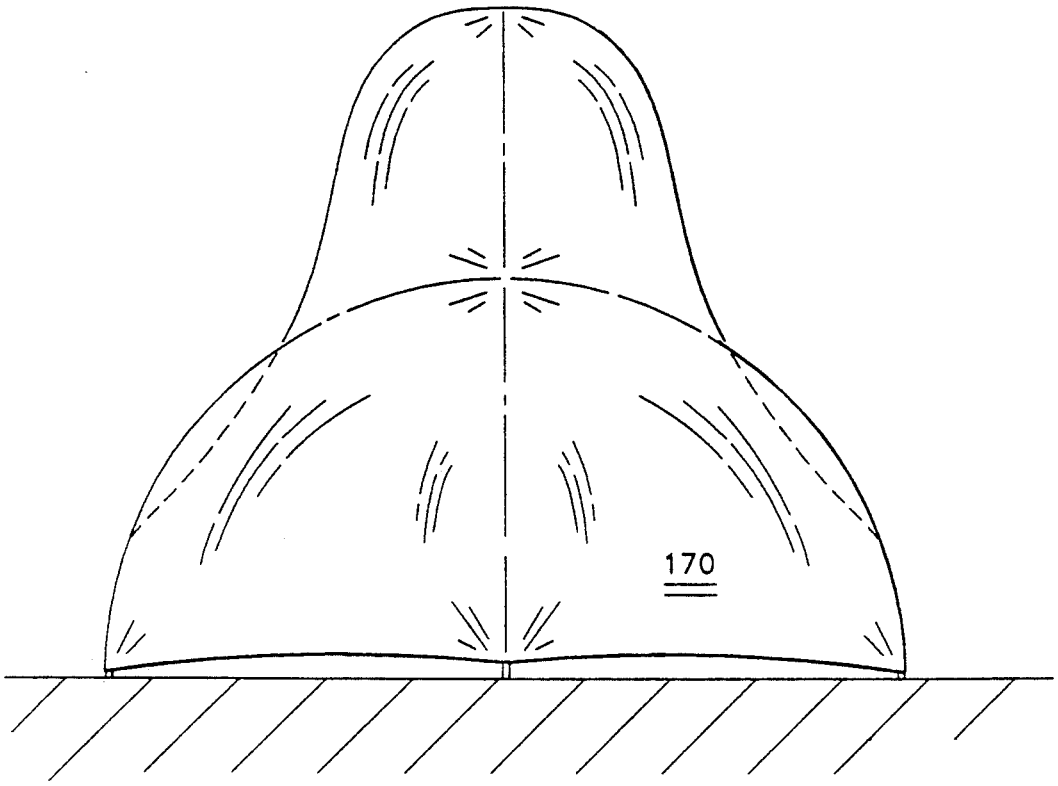
FIG. 3 is a rear elevation view of the invention.
Figure 4:
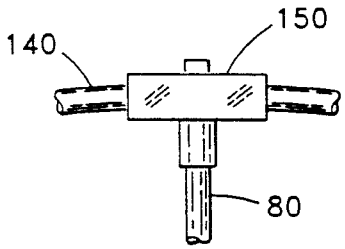
FIG. 4 is an expanded view of the joint shown in circle 4 of FIG. 1.
Figure 5:
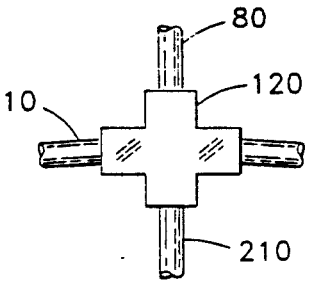
FIG. 5 is an expanded view of the joint shown in circle 5 of FIG. 1.
Figure 6:
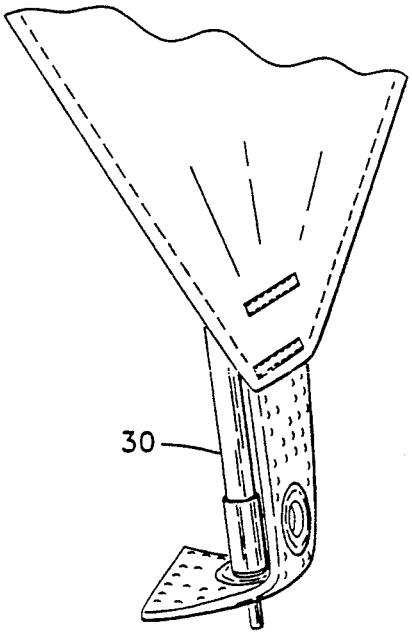
FIG. 6 is an expanded view of the joint shown in circle 6 of FIG. 1.

FIG. 1 shows a sun shade structure. A first flexible rod 10 forms a first arc 20, oriented generally concave down. The ends 30 of the arc 20 are held in place on a horizontal surface 40. The plane of the arc forms an acute angle 70 with the horizontal surface 40 (FIG. 2). A first imaginary line on the horizontal surface 40 connects the ends 30 of the first arc 20.

A second flexible rod 80 forms a second arc 90 (FIG. 2) oriented generally concave down. One end 100 of the second rod 80 is held in place on the horizontal surface 40 at the apogee of the first arc 120 (FIG. 1). A second end 125 of the second rod 80 defines a point in space above a second imaginary line drawn on the horizontal surface 40 as a normal bisector of the first imaginary line.

A third flexible rod 140 forms a third arc 160 (FIG. 1) oriented generally concave down. The midpoint 150 of the third flexible rod 140 is attached to the second end 125 of the second rod 80. Preferably, the first rod 10, the second rod 80, and the third rod 140 are each constructed of at least one individual rod segment 210, each rod segment 210 joined to the next rod segment 210 by a connector 220 (FIG. 1).

A fabric cover 170 is stretched over the first rod 10, second rod 80, and third rod 140 such that a partially closed structure is formed. The cover 170 has a horizontal edge 180 and a generally vertical edge 190 (FIG. 2). The horizontal edge 180 extends between the ends 30 of the first rod 10 and the first end 100 of the second rod 80. The vertical edge 190 extends between the ends 30 of the first rod 10 at the horizontal surface 40 and the second end 125 of the second rod 80. The third rod 140 extends along a midportion 200 of the vertical edge 190. In the preferred embodiment of the invention the fabric cover 170 is attached to the ends 30 of the first rod 10 and to the second end 125 of the second rod 80.

In operation, each rod segment 210 is joined to the next rod segment 210 at a connector 220. The ends of the first rod 10 and the first end 100 of the second rod 80 may each be inserted into the horizontal surface 40. The first rod 10 is attached to the apogee 120 of the first arch 120 formed by the first rod 10. The third rod 140 is attached at the midpoint 150 thereof the second end 125 of the second rod. The fabric cover 170 is stretched over the first rod 10, the second rod 80 and the third rod 120 such that a partially closed structure is formed. The cover 170 is then attached to the ends 30 of the first rod 10 and to the second end 125 of the second rod 80.

While the invention has been described with reference to a preferred embodiment, it is to be clearly understood by those skilled in the art that the invention is not limited thereto. Rather, the scope of the invention is to be interpreted only in conjunction with the appended claims.

I claim:

1. A sun shade structure for covering a surface having a first axis and a second axis which bisects the first axis, said shade comprising:

a first planar, concave rod having first and second ends on said first axis and an apogee substantially midway between said ends, the plane of said concave rod extending at an acute angle with said surface, a second planar, concave rod having first and second ends with said first end contacting said surface on said second axis and said second end being spaced above said second axis on said surface, said second rod contacting and being supported by said first rod at a point intermediate it's first and second ends, a third concave rod having first and second ends spaced above said surface, said third rod contacting and being supported by said second rod at a point intermediate it's ends, and a fabric cover supported by said first, second, and third rods.

2. The sunshade of claim 1 wherein said first, second, and third rods are flexible.

3. The sunshade of claim 1 wherein said second rod is sufficiently flexible to permit it's second end to be bent down and secured to the ground at a second point along said second axis.

4. The sunshade of claim 1 wherein said first, second and third rods are constructed of a plurality of rod segments joined by connectors.

* * * * *